US010247411B2

(12) United States Patent
Aldrich

(10) Patent No.: US 10,247,411 B2
(45) Date of Patent: Apr. 2, 2019

(54) INTEGRATED BURNER ASSEMBLY

(71) Applicant: Chris Aldrich, Sundre (CA)

(72) Inventor: Chris Aldrich, Sundre (CA)

( * ) Notice: Subject to any disclaimer, the term of this patent is extended or adjusted under 35 U.S.C. 154(b) by 164 days.

(21) Appl. No.: 15/439,825

(22) Filed: Feb. 22, 2017

(65) Prior Publication Data

US 2018/0238540 A1 Aug. 23, 2018

(51) Int. Cl.

| | |
|---|---|
| ***F23D 99/00*** | (2010.01) |
| ***F23D 14/72*** | (2006.01) |
| ***F23N 5/00*** | (2006.01) |
| ***F23D 14/82*** | (2006.01) |

(52) U.S. Cl.

CPC ..... *F23D 91/02* (2015.07); *F23D 14/72* (2013.01); *F23D 14/82* (2013.01); *F23N 5/00* (2013.01); *F23D 2900/21* (2013.01)

(58) Field of Classification Search

CPC ..... F23D 91/02
USPC ..... 431/6
See application file for complete search history.

(56) References Cited

U.S. PATENT DOCUMENTS 4,637,792 A * 1/1987 Davis ..... B08B 3/02 431/1
4,651,524 A * 3/1987 Brighton ..... F01N 3/025 55/282
7,905,722 B1 * 3/2011 Heath ..... B01D 53/002 236/11
2003/0200947 A1 * 10/2003 Harris ..... F01L 1/053 123/90.43
2006/0160042 A1 * 7/2006 Kretschmer ..... F23C 5/02 431/343
2008/0115969 A1 * 5/2008 Micu ..... B60R 16/0215 174/72 A
2009/0078245 A1 * 3/2009 Chang ..... A47J 37/0713 126/25 B

OTHER PUBLICATIONS

Heating Solutions International Inc.; Integral 950 Flame Arrester; http://www.heatingsolutionsinternational.ca/integral-950-flame-arrester/; printed Feb. 6, 2017.
Kenilworth Combustion Model# 01-U5_2011_HP_PILOT; printed from www.kenilworth.ca; Feb. 2017.
(Continued)

*Primary Examiner* — Avinash A Savani
(74) *Attorney, Agent, or Firm* — Parlee McLaws LLP (CGY); Linda Thompson; Sean Goodwin

(57) ABSTRACT

Embodiments of integrated burner assemblies, for use in classified hazardous areas, effectively utilize a designated general or non-classified area classification inside a burner housing to simplify wiring connections between various components of a managed burner system. A valve train which supplies fuel to the burner and a control unit which manages the burner assembly and the valve train are mounted external to the burner housing in a classified hazardous area. Mechanically protected wiring is used to connect the valve train and control unit to the non-classified area. The open wiring connections inside the non-classified area, connecting between the burner assembly and the mechanically protected wiring from the control unit and the mechanically protected wiring from the valve train are free of mechanically protection considerations.

18 Claims, 5 Drawing Sheets

(56) References Cited

OTHER PUBLICATIONS

Kenilworth Combustion Model# 05-U10_2011_HP_PILOT; printed from www.kenilworth.ca; Feb. 2017.
Kenilworth Combustion Model# 01-BTEX_2012_LP_PILOT; printed from www.kenilworth.ca; Feb. 2017.

* cited by examiner

INTEGRATED BURNER ASSEMBLY

FIELD

Embodiments taught herein relate to burner systems for use in hazardous locations and, more particularly to integrated burner systems having pre-assembled components for simplifying installation, certification and supply.

BACKGROUND

Natural draft burners are used in a variety of process apparatus, such as line heaters, reboilers, heat treaters, free water knockout drums, storage tanks and the like, commonly used in the oil and gas industry. One or more natural draft burners are supported in a firetube which extends into the vessel for transferring heat directly or indirectly thereto for heating fluids therein.

Such equipment is often located on oil and gas sites, or other industrial sites having the possibility of fugitive hydrocarbons and at which ignition sources are carefully controlled.

On-site areas having process apparatus are generally classified as Class I, Division 2, according to the National Electrical Code (NEC) or NFPA 70, a regionally adoptable standard for the safe installation of electrical wiring and equipment in the United States. A similar code, the Canadian Electrical Code (CEC) or CSA C22.1, is a standard published by the Canadian Standards Association (CSA) pertaining to the installation and maintenance of electrical equipment in Canada.

An area is generally classified in North America as Class I, Division 2 when one of the following conditions exists:

- volatile flammable liquids or flammable gases are handled, processed or used, but the hazardous liquids, or gases will normally be confined within closed containers or closed systems from which they can escape only in event of accidental rupture or breakdown of such containers or systems, or as a result of abnormal operation of equipment; or
- ignitable concentrations of gases or vapors are normally prevented by positive mechanical ventilation, and which might become hazardous through failure or abnormal operations of ventilating equipment; or
- adjacent to a Class I, Division 1 location and to which ignitable concentrations of gases or vapors might occasionally be communicated unless such communication is prevented by adequate positive pressure ventilation from a source of clean air, and effective safeguards against ventilation failure are provided.

Under the CEC, to operate a fired heater in a Division 2 area, the fired heater must be totally enclosed, all surfaces exposed to the atmosphere must operate below the temperature that would ignite a flammable substance present in the hazardous area, the combustion air intake and exhaust discharge must be equipped with a flame arresting device, and electrical components isolated from the atmosphere or at an energy level below that required to ignite a specific hazardous atmospheric mixture. Otherwise, the fired heater must be located outside the hazardous area.

A flame arrestor ensures adequacy of a flow of primary air from the surrounding atmosphere for burner combustion while preventing propagation of the flame from the burner, back along the combustion air source, to the atmosphere. The volume within a burner housing to which a flame arrestor has been installed, inherently exposed to the burner combustion conditions, is generally considered a non-classified area according to the appropriate codes.

It is common practice to utilize burner systems that are connected to burner management or control systems. Such systems both monitor burner operation, including the presence of flame, and to ensure safe start-up, operation and shutdown of the burners. The burner management system generally comprises flame-detectors for main burners and pilot burners to ensure the burners are lit. The control system is connected to fail-safe mechanisms and solenoid-operated valves for shutting off the flow of gas or vapours to the burners should a flame not be sensed. The burner control system generally comprises circuitry to re-light the burners when safe to do so and may provide communication of data to a data acquisition system. The control system also acts to modulate the burner flame intensity based on temperature requirements of the various process apparatus.

In addition to fugitive emissions in the general atmosphere about the burner system, the burner itself can be a source of combustible vapors. In the absence of a burner management system, when the flame is not present, gas could continue to flow at least to the pilot, irrespective the lack of the flame, releasing unburned fuel. Further as the process apparatus begins to demand heat, gas is also fed to the main burner irrespective of the absence of a flame. Release of gas, from the unlit pilot and main burners, to the atmosphere creates an ignition or explosion risk.

Under the various electrical codes, specific wiring requirements are established for use in hazardous or classified areas such as Class 1, Div 2. Conventional burner systems, as described above, typically utilize one or more burners and a control unit. The control unit is wired to the burners for managing the burner and for managing the valve train which supplies the gas. The control unit and connective wiring generally comprises a complex system of mechanically protected wiring systems to meet the code. "Mechanically protected" generally means that, while the electrical equipment is capable of producing sufficient energy, such as heat or electrical spark, to ignite an explosive atmosphere, it has been mechanically protected or contained so as to prevent the ignition. In the case of electrical equipment located in hazardous areas, explosion proof enclosures, rigid conduit fittings and hermetic sealing are known methods of mechanical protection. In common practice, a burner assembly, flame arrestor, burner management system or control unit and the valve train are delivered to a site. Onsite, specialized personnel are employed to electrically connect between the various components of the system, taking into consideration the necessary electrical codes, particularly where the combustion unit is to be placed in a hazardous Class 1, Division 2 area. Once connected, the system must be inspected onsite to ensure compliance with the various codes. The electrical connections are many, between various controls, valves and sensors, and each connection or junction must be in compliance.

This is a time consuming and expensive system and fraught with re-work to bring the installation into compliance. Further, if improperly installed, such systems present significant hazard to onsite personnel.

Clearly, there is a need for simplified, safe installation procedures for combustion units and cost effective wiring systems to meet the electrical code requirements.

SUMMARY

Embodiments of integrated burner assemblies, for use in classified hazardous areas taught herein, effectively utilize a designated general or non-classified area classification inside a burner housing to simplify wiring connections between various components of a managed burner system. A valve train which supplies fuel to the burner and a control unit which manages the burner assembly and the valve train are mounted external to the burner housing in a classified area such as a Class 1 Division 2 hazardous area. Mechanically protected wiring is used to connect the valve train and control unit to the non-classified area of the burner housing. The wiring connections inside the non-classified area, between the mechanically protected wiring from the control unit and the burner, and between the mechanically protected wiring from the control unit and the mechanically protected wiring from the valve train, can be pre-wired, or the final connections wired in the field, are open connections free of mechanical protection.

In one broad aspect, an integrated burner system for use in a classified area comprises a burner housing having a burner assembly, an air inlet end and a combustion end. A flame arrestor is fluidly connected to the air inlet end for forming a non-classified area in the burner housing between the burner assembly and the flame arrestor. A control system is located in the classified area external to the burner housing. Mechanically protected wiring extends between the control system and the non-classified area of the burner housing. A valve train, in the classified area external to the burner housing, supplies fuel to the burner for combustion thereat. Mechanically protected wiring extends between the valve train and the non-classified area of the burner housing. Electrical connections are formed within the non-classified area of the burner housing, between the burner assembly, the mechanically protected wiring from the control system and the mechanically protected wiring of the valve train area.

In another broad aspect, a method for pre-assembly of an integrated burner system for equipment used in a classified environment comprises installing a burner assembly at a combustion end of a burner housing and installing a flame arrestor at an air intake end of the burner housing forming a non-classified area between the burner assembly and the flame arrester. A control unit, located in the classified area, is connected using mechanically protected wiring to the non-classified area. A valve train, located in the classified area is fluidly connected to the burner for supplying fuel thereto. The valve train is connected using mechanically protected wiring to the non-classified area. Open electrical connections are formed in the non-classified area between the burner assembly, the mechanically protected wiring from the control unit and the mechanically protected wiring from the valve train.

In embodiments, the non-classified area forms a first chamber. A perimeter of the burner housing is extended and a discontinuous barrier is located therein for forming a second non-classified chamber. The electrical connections are housed in the second non-classified chamber and the barrier acts as a heat barrier to minimize damage to the electrical connections in the second chamber.

In embodiments, the second chamber is below the first chamber. A lip is formed along the discontinuity of the barrier for forming a containment in the first chamber for receiving any liquid, such as condensation from the burner, therein. The containment prevents the liquid from freely draining into the second chamber.

DETAILED DESCRIPTION

Prior Art

Figure 1A:
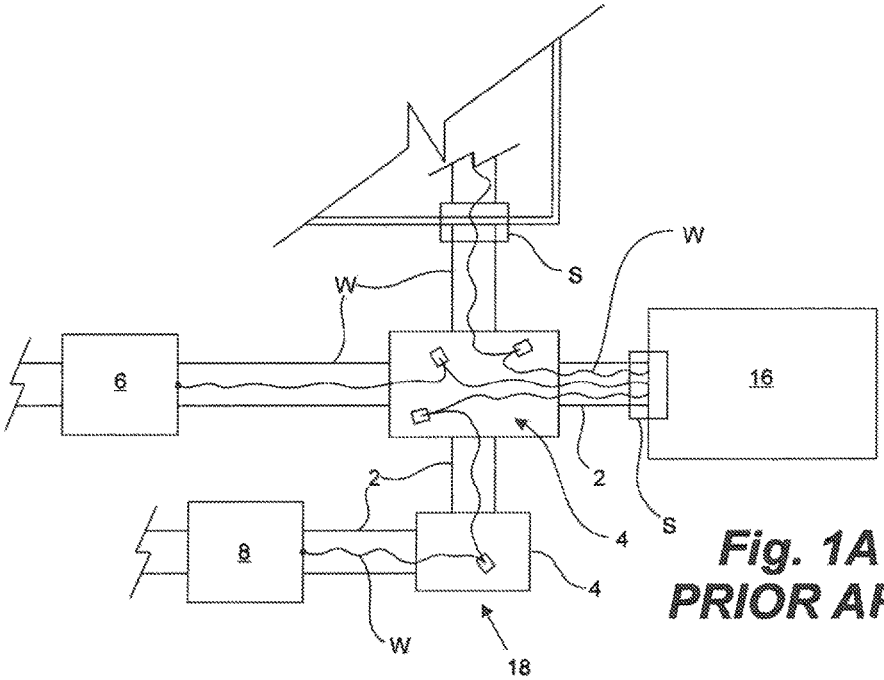
Fig. 1A PRIOR ART
FIG. 1A is a simplified schematic illustrating a burner assembly in a burner housing and a prior art mechanically protected wiring method for electrical connections between a control unit, each of the components of a valve train supplying fuel to the burner assembly, and the burner assembly itself.

As shown simplistically in FIG. 1A, all electrical equipment and wiring located in a Class 1, Division 1 or Division 2 hazardous area is required to be in accordance with regulations set forth according to appropriate electrical codes. Mechanically protected electrical systems are used. For example, mechanically protected wiring W between components of the system is run in rigid metal conduit or threaded steel intermediate conduit 2. Conduit fittings are suitable for the hazardous location. Flexible connections are typically required and, where crossing boundaries between classifications, the connections and fittings are sealed S thereat. Generally, the connections are also liquid tight. Explosion proof junction boxes 4 may also be required for effecting electrical connections between components. Components such as solenoids 6, pressure switches 8 and the like, used to control and monitor the flow of fuel, are typically hermetically-sealed units with electrical leads extending therefrom. Those leads must be terminated in accordance with the codes.

Others have provided integrated systems which have a pre-assembled package including a burner 10 and a flame arrester 12, both of which are in a housing 14. Further, a burner management system or control unit 16 and a valve train 18 are included in the package for delivery to the site. Known systems however still require mechanically protected wiring methods for use in hazardous Class 1, Division 2 locations. On-site, personnel are expected to connect the valve train components and control unit, and then certify the system.

Figure 1B:
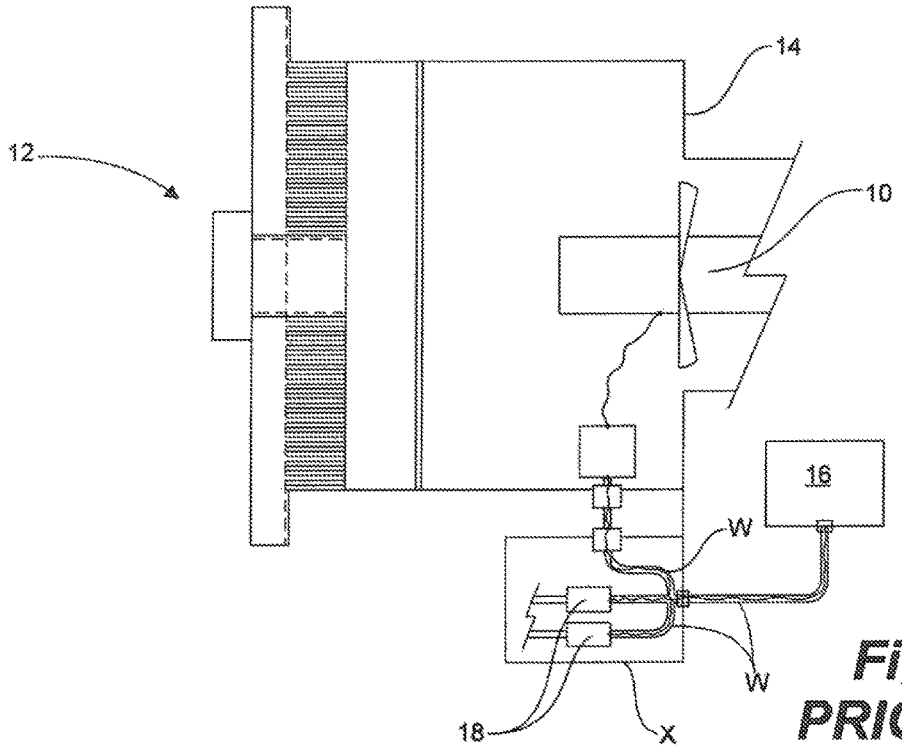
Fig. 1B PRIOR ART
FIG. 1B is a schematic illustrating a conventional, prior art mechanically protected wiring method between a burner housing having a flame arrestor installed thereto and a valve train, the valve train being installed in an explosion proof enclosure separate from the burner housing, and a control unit external thereto.

Having reference to FIG. 1B, and in one prior art approach to enable a level of pre-certification, a model Integral 950 Flame Arrester, from Heating Solutions International Inc. of Lloydminster, Saskatchewan, Canada, provides an explosion-proof, mechanically protected enclosure X provided adjacent the burner housing 14 and connected thereto through mechanically protected connections. A flame arrestor 12 is installed to the burner housing 14. The enclosure X is a separate enclosure from the burner housing 14. As the enclosure X contains both electrical and fuel-handling components of the valve train 18, as well as wiring W between the control unit 16 and the burner assembly 10, the environment within the enclosure is classified as hazardous under Class 1, Division 2. Therefore, the system continues to require complex and costly, mechanically protected wiring methods to be used within the enclosure X, as well as external thereto.

Figure 1C:
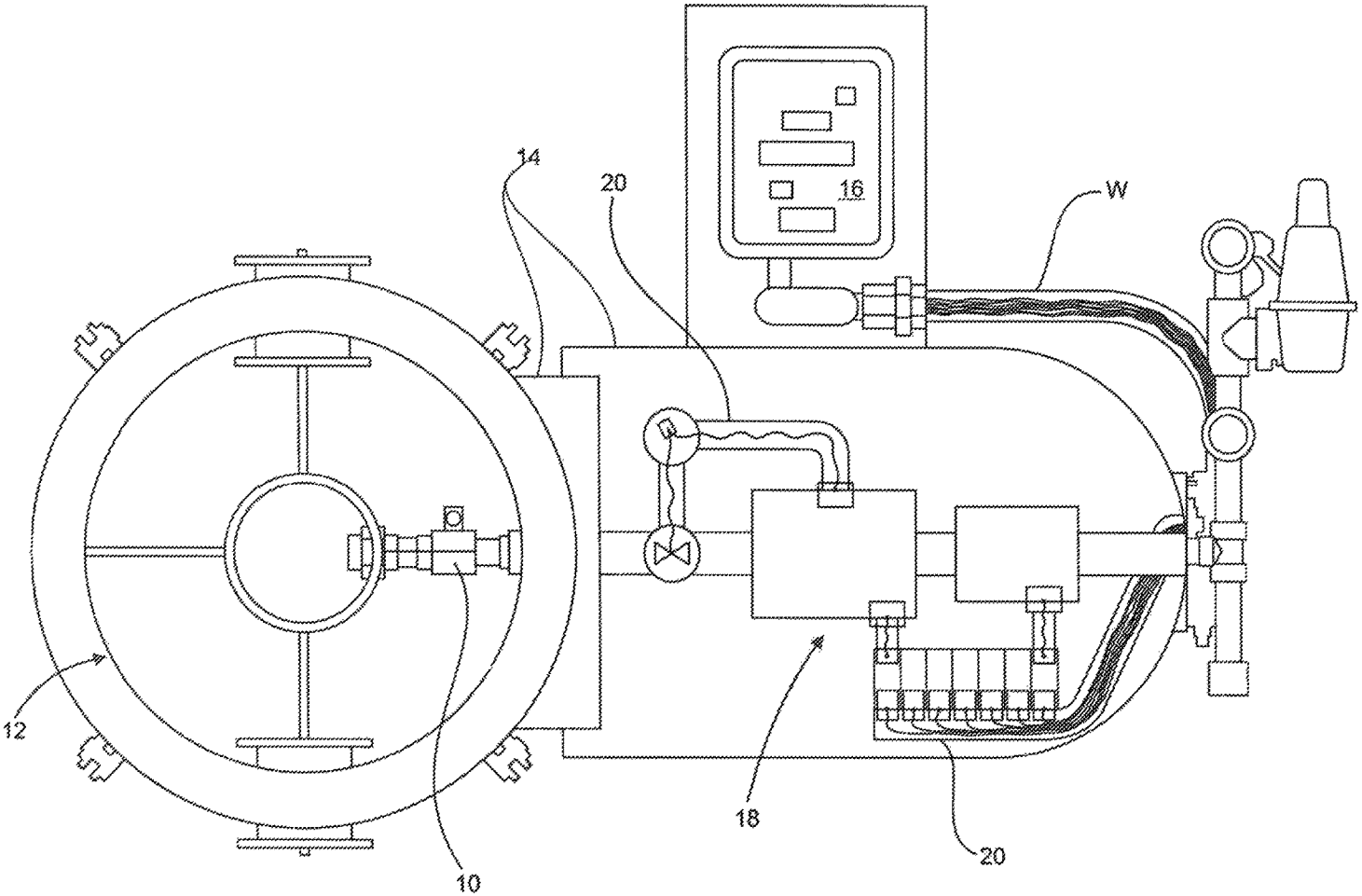
FIG. 1C is a schematic illustrating a prior art burner system having a burner housing, and at least portions of the valve train located internal to an extension of the burner housing, all connections for each of the valve train and the control unit within the housing being classified as located in a hazardous area, the electrical connections therein being mechanically protected connections.

As shown in FIG. 1C, in another series of known pre-assembled systems available from Kenilworth Combustion of Vermilion, Alberta, Canada, the burner housing 14 has the burner 10 and flame arrestor 12 installed thereto. Components of the valve train 18, including gas/fuel connections, as well as wiring connections 20 to the burner 10 and valve train 18 from the control unit 16 are located within an extension of the burner housing 14 and supported structurally therefrom. Again, despite connection of the flame arrestor 12 to the burner housing 14, the burner housing 14 cannot be considered non-hazardous as it houses both electrical and fuel-handling components. Thus, the wiring connections 20 both therein and wiring W external thereto must be in compliance with the complex electrical requirements of Class 1 Division 2 as described above.

Embodiments

Figure 2A:
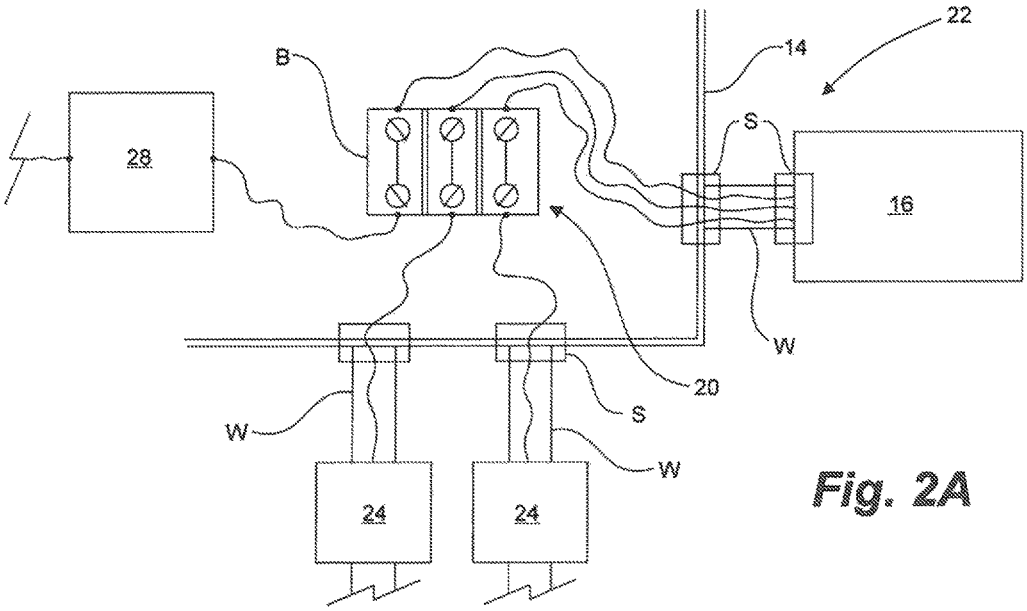
FIG. 2A is a schematic illustrating a wiring method according to an embodiment taught herein, having a control unit pre-wired to a portion of a non-classified burner housing and components of a valve train also pre-wired to the non-hazardous burner housing, all electrical connections being completed within the non-classified burner housing using non-hazardous wiring methods, all pre-wiring being mechanically protected wiring methods.

As shown in FIG. 2A, embodiments of a burner assembly 22 taught herein effectively utilize a general or non-classified classification designated inside the burner housing 14 to simplify wiring connections 20. The open wiring connections can be pre-wired, or the final connections wired in the field, free of mechanically protected considerations. A control unit 16 is connected to the burner housing 14 using mechanically protected methods. Electrical components 24 of the valve train 18, for supplying fuel to the burner 10 and the like, located external to the burner housing 14, are connected to the burner housing 14 using mechanically protected methods. Wiring W extends from each of the electrical components 24 and control unit 16, from their respective explosion proof environments, to the non-classified area A of the burner housing 14. Further, open electrical connections 20, extend from the burner housing 14 to the burner 10, free from mechanically protected considerations.

The burner housing 14 comprises an air inlet end 26 and a combustion end 28, the burner 10 being mounted at the combustion end 28 and the flame arrestor 12 being mounted to the air inlet end 26. At least the portion of the burner housing 14 therebetween is classified as the non-classified area A.

The control unit 16, valve train 18 and electrical components 24 thereof are located external to the burner housing 14, generally in a Class 1, Division 2 location. Wiring W is supplied from the control unit 16 to the burner housing 14 and from the valve train's electrical components 24 to the burner housing 14, using mechanically protected wiring methods, suitable for Class 1, Division 2 locations. The electrical components 24 in the valve train 18 are typically hermetically sealed solenoids, pressure switches and the like, already in compliance with mechanically protected requirements.

The wiring W, received at the non-classified burner housing 14 from the control unit 16 is readily connected therein, such as at a terminal block B, to the burner 10 and an ignition unit 28 and to other wiring W received from the electrical components 24 using simplified wiring methods suitable for non-classified or non-hazardous areas. Thus, overall, the electrical wiring is simplified compared to the prior art systems shown in FIGS. 1A to 1C and the resulting costs reduced.

The burner system 22 can be pre-assembled, pre-wired, pre-tested, and inspected prior to delivery onsite. Once onsite, personnel need only mount the system 22 to the onsite equipment, connect the control unit 16 to a source of power and connect the valve train 18 to a source of fuel. Wiring at the terminal blocks B can remain as pre-wired, or be finalized, or revised, such work being performed in the non-classified area of the burner housing 14, without a concern for disturbance of any individual mechanically protected connections.

Figure 2B:
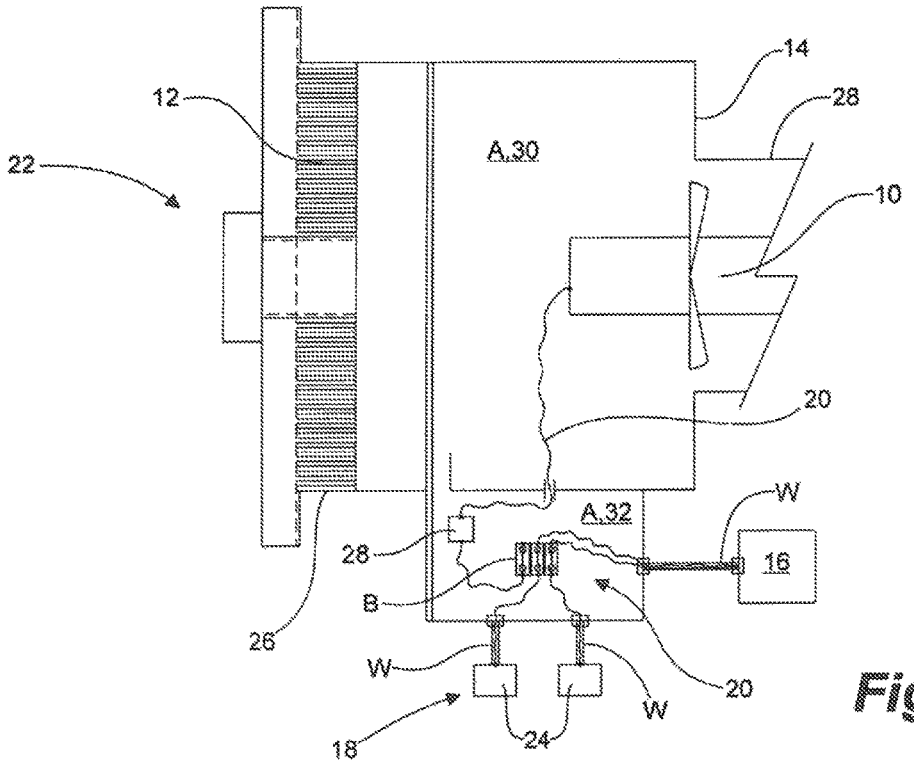
FIG. 2B is an overall schematic of the cross-section of the burner housing and the wiring method of FIG. 2A, the electrical connections being made within an perimeter extension of the non-classified area of the burner housing to which a flame arrestor has been installed.
Figure 3:
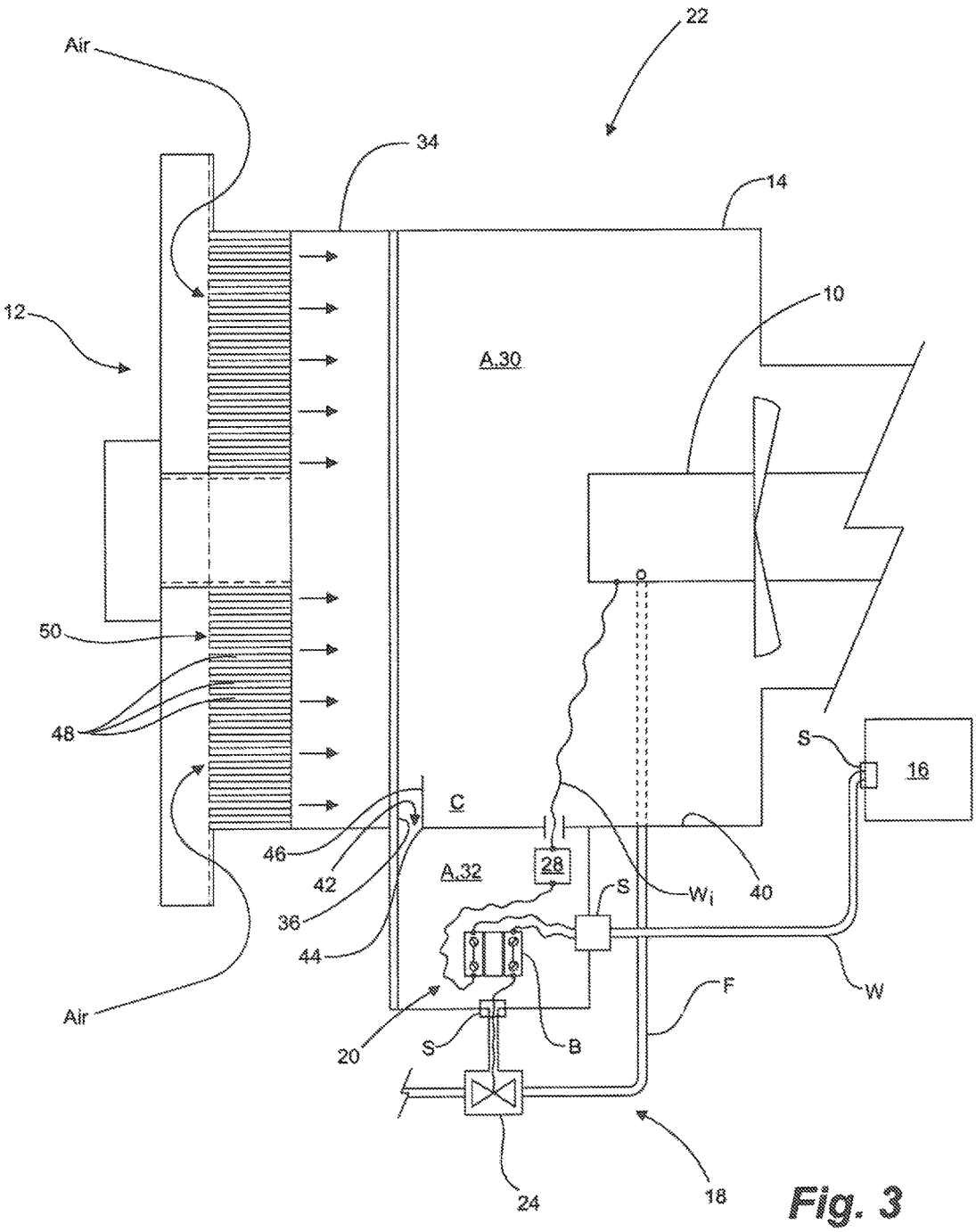
FIG. 3 is an enlarged side view according to FIG. 2B and illustrative of example components selected from the valve train and the control unit.
Figure 4:
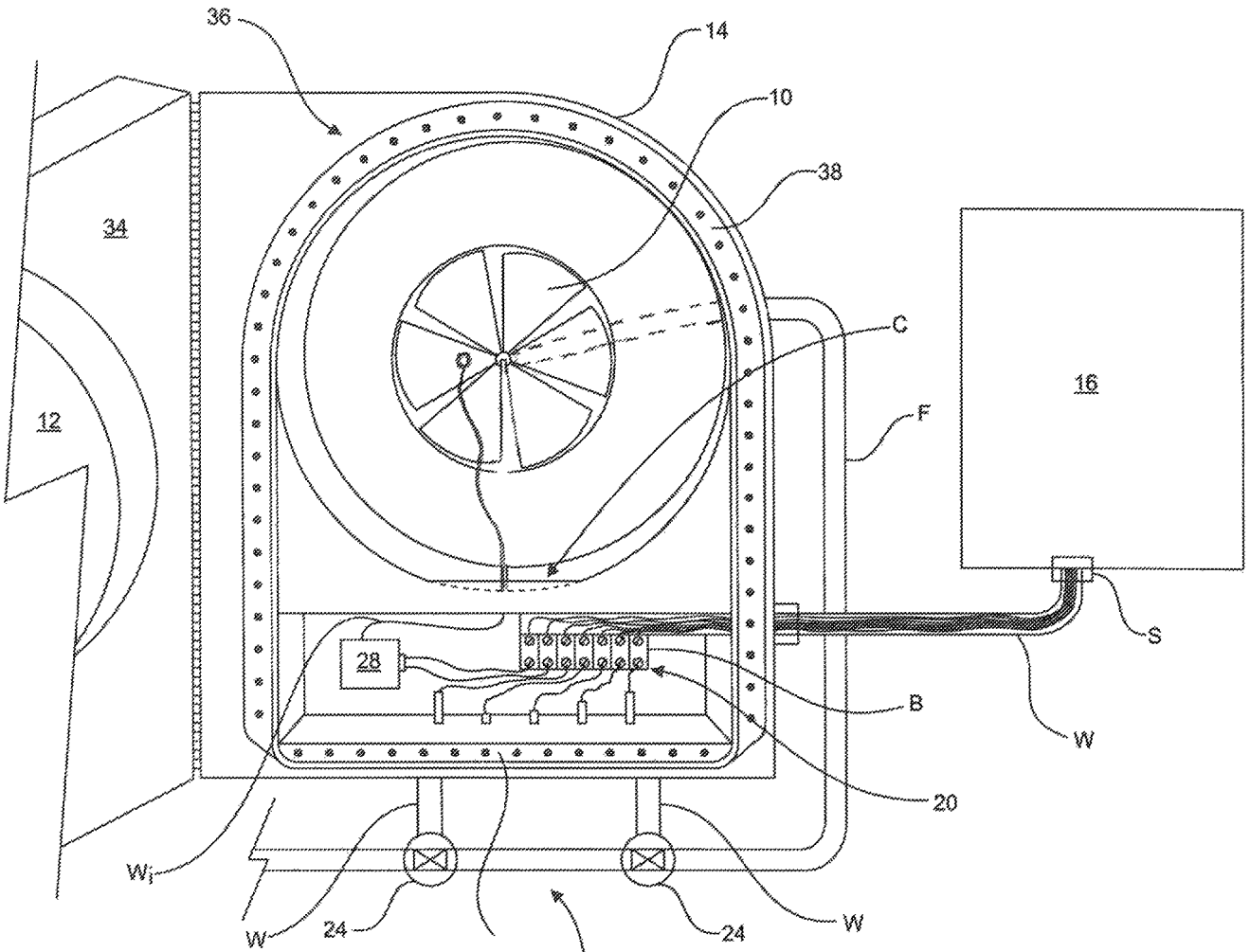
FIG. 4 is an end front view according to FIG. 3, with an end door supporting the flame arrestor, opened for viewing the electrical connections housed in the non-classified area.

Having reference to FIGS. 2B, 3 and 4, in an embodiment, the burner housing 14 is a first non-classified chamber 30 for housing the burner 10 therein. An example of the system can include a natural draft burner assembly.

The burner housing 14 is extended to form a second non-classified chamber 32 connected to the first chamber 30. The second non-classified chamber 32 is used for housing the wiring connections 20 therein. A door 34 is hinged to the burner housing 14 to cover an access opening 36 in the burner housing 14 for enclosing both the non-classified first and second chambers 30,32. A flame arrester 12 is pre-installed in the door 34 of the burner housing 14. A gasket 38, best seen in FIG. 4, is connected to seal between the door 34 and the burner housing 14. In embodiments, the gasket 38 is a tadpole gasket riveted to the burner housing 14 to surround the access opening 36.

A heat barrier 40 is formed between the first and second chambers 30,32 to minimize damage to the wiring connections 20 as a result of heat from the burner 10. The heat barrier 40 is discontinuous therebetween, maintaining the non-classified designation therebetween. In an embodiment, the heat barrier 40 forms a gap 42 between the access opening 36 and a front end 44 of the heat barrier 40.

Further, in embodiments having the second chamber 32 located below the first chamber 30, an upwardly extending lip 46 is formed about the discontinuity, forming a containment C in the first chamber 30 to receive and accumulate liquid therein. Liquid present therein is generally as a result of condensation from the burner 10. The containment C acts to prevent the liquid from freely draining into the second chamber 32 and mitigates risk of contact with the wiring connections 20 therein. In an embodiment, the upwardly extending lip 46 is formed along the heat barrier's front end 44 to form the containment C.

Combustion air is generally admitted through a plurality of passageways 48 formed in a flame cell 50 of the flame arrester 12 to provide a source of primary air for the burner 10. Flame propagation from the burner housing 14, to the atmosphere without, is prevented by the plurality of passageways 48 of the flame cell 50. Applicant understands the passageways cause a reduction in flame generated heat therein, thereby extinguishing any flame. Once installed, the flame arrester 12 is tested using standard API flame testing.

The ignition unit 28 for controlling ignition of the burner 10, including a pilot burner, is also housed within the second chamber 32. Wiring $W_I$ to one or more igniters generally passes through the heat barrier 40 using the simplified wiring methods for non-classified areas and can be protected using liquid tight fittings as the ignition wiring $W_I$ passes through the containment C.

Fuel lines F connecting the valve train 18 to the burner 10 are not routed through the second chamber 32, thereby maintaining the second chamber 32 as a non-classified area. Further, unlike the prior art, piping, regulators and the like which handle the passage of fuel through the valve train 18 are located external to the second chamber 32 for maintaining the second chamber 32 as a non-classified area.

Embodiments in which an exclusive property or privilege is claimed are defined as follows:

1. An integrated burner system for use in a classified area comprising:

a burner housing having a burner assembly, an air inlet end and a combustion end, a flame arrestor fluidly connected to the air inlet end for forming a first non-classified chamber in the burner housing between the burner assembly and the flame arrestor;

a second non-classified chamber extending from the first non-classified chamber;

a discontinuous barrier extending between the first and second non-classified chambers;

a control system located in the classified area external to the burner housing;

a valve train in the classified area external to the burner housing for supplying fuel to the burner for combustion thereat;

mechanically protected wiring extending between the control system and the second non-classified chamber of the burner housing;

mechanically protected wiring extending between the valve train and the second non-classified area of the burner housing; and open electrical connections, formed within the second non-classified chamber, between the burner assembly, the mechanically protected wiring from the control system and the mechanically protected wiring of the valve train area.

2. The integrated burner system of claim 1 wherein the discontinuous barrier is a heat barrier.

3. The integrated burner system of claim 1 wherein the discontinuous barrier is a liquid barrier.

4. The integrated burner system of claim 3 wherein the discontinuous barrier comprises an upwardly extending lip extending along the discontinuity for forming a containment for receiving liquid in the first chamber.

5. A method for pre-assembly of an integrated burner system for equipment used in a classified environment comprising:

installing a burner assembly at a combustion end of a burner housing;

installing a flame arrestor at an air intake end of the burner housing forming a first non-classified chamber between the burner assembly and the flame arrester;

installing a discontinuous barrier in the burner housing for forming a second non-classified chamber therein for housing electrical connections;

connecting mechanically protected wiring between a control unit, located in the classified area, and the second non-classified area;

fluidly connecting a valve train, located in the classified area to the burner for supplying fuel thereto;

connecting mechanically protected wiring between the valve train and the second non-classified chamber; and forming open electrical connections in the second non-classified chamber between the burner assembly, the mechanically protected wiring from the control unit and the mechanically protected wiring from the valve train.

6. The method of claim 5 wherein the discontinuous barrier is a heat barrier.

7. The method of claim 5 further comprising:

installing a lip along the discontinuity for forming a liquid containment within the first chamber for receiving liquid therein.

8. The method of claim 5 further comprising:

testing the system prior to installation onsite; and certifying the system prior to installation onsite.

9. The method of claim 8 further comprising:

delivering the system onsite for installation thereat;

connecting a supply of fuel to the valve train; and connecting a power supply to the control unit for powering the system.

10. The method of claim 5 further comprising:

testing the system prior to installation;

delivering the system onsite for installation thereat;

connecting a supply of fuel to the valve train;

connecting a power supply to the control unit; and certifying the system on-site.

11. A method for pre-assembly of an integrated burner system for equipment used in a classified environment comprising:

installing a burner assembly at a combustion end of a burner housing;

installing a flame arrestor at an air intake end of the burner housing forming a non-classified area between the burner assembly and the flame arrester;

connecting mechanically protected wiring between a control unit, located in the classified area, and the non-classified area;

fluidly connecting a valve train, located in the classified area to the burner for supplying fuel thereto;

connecting mechanically protected wiring between the valve train and the non-classified area;

forming open electrical connections in the non-classified area between the burner assembly, the mechanically protected wiring from the control unit and the mechanically protected wiring from the valve train;

testing the system prior to installation onsite; and certifying the system prior to installation onsite.

12. The method of claim 11, wherein the non-classified area is a first non-classified chamber, further comprising:

extending a perimeter of the burner housing; and installing a discontinuous barrier therein for forming a second non-classified chamber for housing the electrical connections.

13. The method of claim 12 wherein the discontinuous barrier is a heat barrier.

14. The method of claim 12 prior to testing onsite further comprising:

installing a lip along the discontinuity for forming a liquid containment within the first chamber for receiving liquid therein.

15. A method for pre-assembly of an integrated burner system for equipment used in a classified environment comprising:

installing a burner assembly at a combustion end of a burner housing;

installing a flame arrestor at an air intake end of the burner housing forming a non-classified area between the burner assembly and the flame arrester;

connecting mechanically protected wiring between a control unit, located in the classified area, and the non-classified area;

fluidly connecting a valve train, located in the classified area to the burner for supplying fuel thereto;

connecting mechanically protected wiring between the valve train and the non-classified area;

forming open electrical connections in the non-classified area between the burner assembly, the mechanically protected wiring from the control unit and the mechanically protected wiring from the valve train;

testing the system prior to installation;

delivering the system onsite for installation thereat;

connecting a supply of fuel to the valve train;

connecting a power supply to the control unit; and certifying the system on-site.

16. The method of claim 15, wherein the non-classified area is a first non-classified chamber, further comprising:

extending a perimeter of the burner housing; and installing a discontinuous barrier therein for forming a second non-classified chamber for housing the electrical connections.

17. The method of claim 16 wherein the discontinuous barrier is a heat barrier.

18. The method of claim 16 further comprising:

installing a lip along the discontinuity for forming a liquid containment within the first chamber for receiving liquid therein.

* * * * *